US005900839A

United States Patent [19]

Duperray

[11] Patent Number: 5,900,839

[45] Date of Patent: May 4, 1999

[54] RADIO TRANSMISSION APPARATUS COMPRISING A RETRACTABLE ANTENNA AND AN ANTENNA DEVICE FOR SUCH APPARATUS

[75] Inventor: David Duperray, Le Mans, France

[73] Assignee: U.S. Philips Corporation, New York, N.Y.

[21] Appl. No.: 08/927,887

[22] Filed: Sep. 11, 1997

[30] Foreign Application Priority Data

Sep. 25, 1996 [FR] France ..... 96 11667

[51] Int. Cl.[6] ..... H01Q 1/24

[52] U.S. Cl. ..... 343/702; 343/895; 343/900

[58] Field of Search ..... 343/702, 895, 343/900, 901, 906; H01Q 1/24

[56] References Cited

U.S. PATENT DOCUMENTS

| | | | |
|---|---|---|---|
| 5,548,827 | 8/1996 | Hanawa et al. | 343/702 |
| 5,650,789 | 7/1997 | Elliott et al. | 343/702 |
| 5,764,191 | 6/1998 | Tsuda | 343/702 |

FOREIGN PATENT DOCUMENTS

| | | | |
|---|---|---|---|
| 0644606A1 | 3/1995 | European Pat. Off. | H01Q 1/24 |
| WO9512224 | 5/1995 | WIPO | H01Q 1/24 |

*Primary Examiner*—Hoanganh Le
*Attorney, Agent, or Firm*—Dicran Halajian

[57] ABSTRACT

A radio communication apparatus is disclosed having a transceiver which receives and transmits signals; an excitation link which is connected to the transceiver; and a rod antenna which is electrically connected at a first tip to the excitation link in an extended position and electrically disconnected from the excitation link in a retracted position. A first coil is located around the rod antenna in a housing, where the first coil has a first end connected to the excitation link. Further, a conducting ring is located over the housing, where the conducting ring contacts a second end of the first coil. An insulating element is located at a second tip of the rod antenna, and a conductive plate is located over the insulating element. The conductive plate is perpendicular to the rod antenna and is parallel to the conducting ring. In addition, a second coil is connected to the conducting plate, where the conducting plate contacts the conducting ring in the retracted position of the rod antenna to connect the two coils in series and form a coil having a length which equals the sum of the lengths of the two coils.

12 Claims, 2 Drawing Sheets

RADIO TRANSMISSION APPARATUS COMPRISING A RETRACTABLE ANTENNA AND AN ANTENNA DEVICE FOR SUCH APPARATUS

FIELD OF THE INVENTION

The invention relates to a radio transmission apparatus comprising an antenna device that can be extended from a retracted position to an extended position, which device is formed by:

- an excitation link to be connected to transceiver circuits,
- a first radiation spiral of which one end is connected to said excitation link,
- a radiation wire for radiating and/or capturing energy from or in the direction of said excitation link, notably in extended position,
- a second spiral positioned in the neighborhood of the second end of said wire.

The invention likewise relates to an antenna device for such an antenna.

BACKGROUND OF THE INVENTION

The invention finds highly significant applications in the field of mobile radio used in cellular networks of the GSM, AMPS, ETACS, etc. . . . type. In modern networks, the passband used is relatively large. As the apparatus used is portable, the dimensions are desired to be small, which imposes on the antennas the necessity of also being as compact as possible, particularly when the apparatus is in the standby mode for a communication. The antennas are in that case put in their retracted position. One is thus confronted with the problem that a wideband operation is to be harmonized with compactness of the antennas. It should be recollected that there are problems when compact antennas are to operate with a wide band.

An apparatus formed by such an antenna device is known from European patent document No. 0 644 606.

This antenna has the drawback that, in retracted position, the wire continues to be connected to the excitation device and, when the apparatus is in the transmit mode, radiates energy inside the apparatus which may be annoying to circuits which receive the radiated wave and also annoying for wave reception when the apparatus is in the receive mode.

SUMMARY OF THE INVENTION

The invention proposes an apparatus of the type defined in the opening paragraph, which largely mitigates said drawback.

Therefore, such an apparatus is characterized in that it is formed, for example, by:

- an insulating element for insulating the second end of said wire of said second spiral.

Thus, thanks to this insulating element, the radiation of the second spiral is considerably diminished in extended position.

Such an apparatus is also characterized according to another characteristic feature of the invention, in that said wire has on its other end a contact piece to be connected to said excitation link in retracted position.

Thus, according to the invention, in extended position, the wire and the first spiral take part in the radiation and, in retracted position, the two spirals are joined to take part in the radiation.

These and other aspects of the invention will be apparent from and elucidated with reference to the embodiments described hereinafter.

DETAILED DESCRIPTION OF THE INVENTION

Figure 1A:
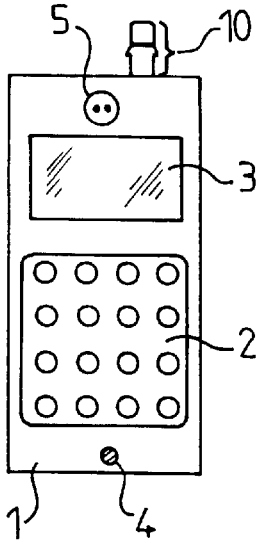
FIGS. 1A and 1B show an apparatus according to the invention with a retracted and an extended antenna, respectively.
Figure 1B:
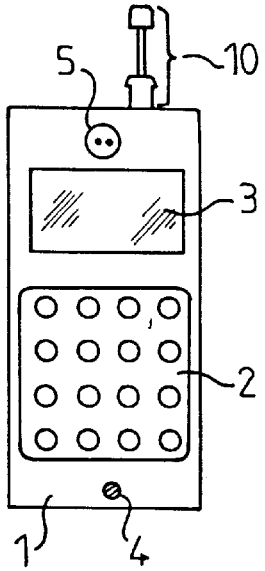

In FIGS. 1A and 1B are shown an apparatus 1 according to the invention. This apparatus may be a GSM terminal and is thus to have small dimensions. It comprises, as is customary, a keyboard 2, a screen 3, a microphone 4 and a loudspeaker 5. It also includes an antenna device 10 in a retracted position, which is shown in FIG. 1A, and an extended position which is represented in FIG. 1B. The retracted position is used when the apparatus is in the standby mode for a communication. This implies that only the receiver part of the apparatus is in operation. In extended position of the antenna, the apparatus is transmitting and in that case, when the antenna is matched, performance is to be better.

Figure 2A:
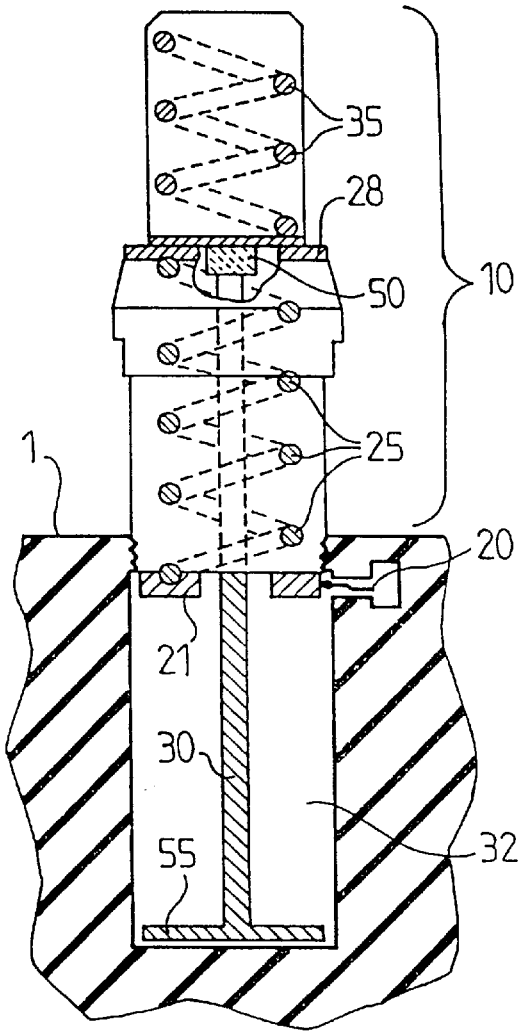
FIGS. 2A and 2B show the antenna in FIGS. 1A and 1B in greater detail.
Figure 2B:
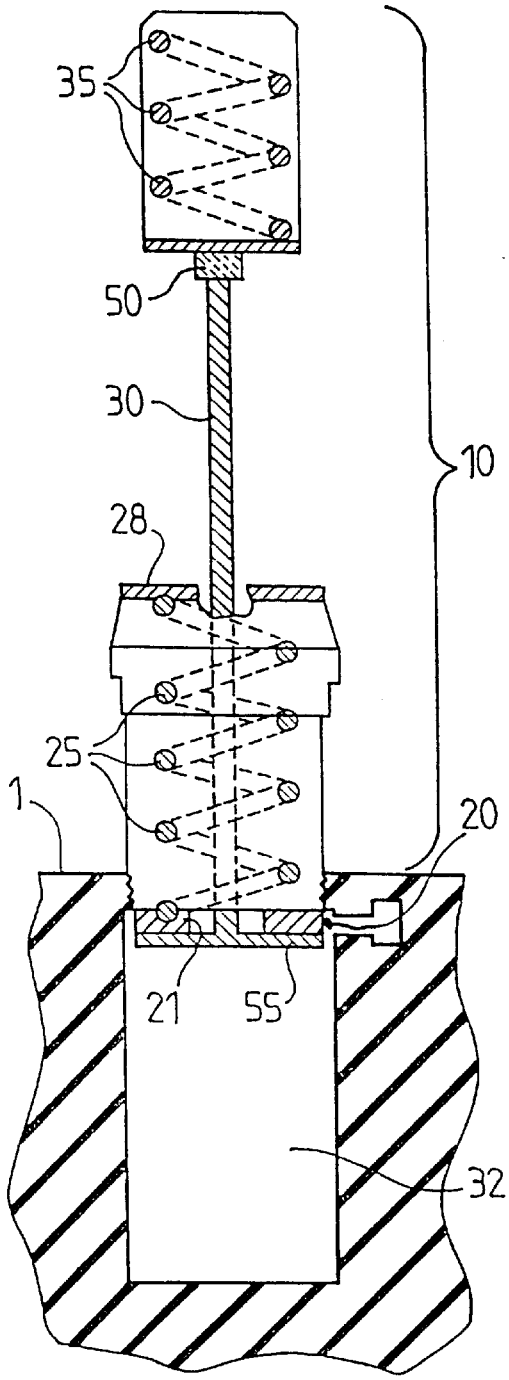

FIGS. 2A and 2B show in more detail the antenna device 10. In FIG. 2A, this antenna is shown in retracted position and in FIG. 2B in extended position. In FIGS. 2A and 2B, reference 20 indicates the excitation point of the antenna. This point is in contact with a conducting ring 21 which is in contact with a first end of a first spiral 25. The other end of this spiral is in contact with a conducting ring 28. These two rings 21 and 28 allow a radiation wire 30 to pass. This radiation wire penetrates a cavity 32 provided in the apparatus 1 when the antenna is in retracted position, and comes out when the antenna is in extended position. A second spiral 35 is placed above this radiation wire 30.

According to the invention, an insulating element 50 makes a mechanical link of this spiral 35 with the upper end of said wire 30 possible. This element is made visible in FIG. 2A by a cut-out part provided in the drawing.

The lower end of the wire 30 is mechanically and electrically connected to a circular conducting part 55.

Thus, when the antenna is in extended position, the wire 30 and the spiral 25 take part in the radiation. As the electric lengths of this wire and of this spiral are close to $\lambda/4$ (where $\lambda$ is a mean wavelength at which the antenna radiates), the antenna has a large bandwidth due to these two coupled resonance systems.

When the antenna is in retracted position, the two spirals are put in series or in cascade, which increases their mechanical height and, because of this, the radio efficiency linked with this height.

Figure 3A:
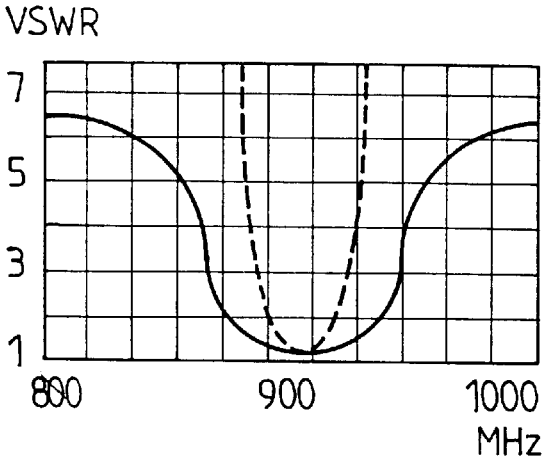
FIGS. 3A and 3B show voltage standing wave ratio plots for the antenna in the extended and retracted positions, respectively.
Figure 3B:
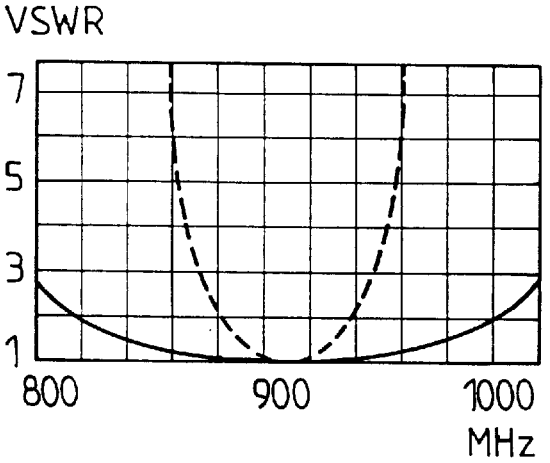

FIGS. 3A and 3B show the performance, expressed in Voltage-Standing Wave Ratios (VSWR) obtained by these antennas.

In FIG. 3A, the performance of the antenna shown in an unbroken line is compared with that of a $\lambda/4$ wire shown in a dashed line.

In FIG. 3B, the performance of the antenna shown in an unbroken line is compared with that shown in a dashed line of a single spiral.

I claim:

1. A radio communication apparatus comprising:

a transceiver which receives and transmits signals;

an excitation link which is connected to said transceiver;

a rod antenna which is electrically connected at a first tip to said excitation link in an extended position and electrically disconnected from said excitation link in a retracted position;

a first coil located around said rod antenna in a housing, said first coil having a first end connected to said excitation link;

a conducting ring located over said housing, said conducting ring contacting a second end of said first coil, said second end being opposite said first end;

an insulating element located at a second tip of said rod antenna;

a conductive plate located over said insulating element, said conductive plate being perpendicular to said rod antenna and parallel to said conducting ring; and a second coil connected to said conducting plate; said conducting plate contacting said conducting ring in said retracted position of said rod antenna.

2. The radio communication apparatus of claim 1 wherein, in said retracted position, said first and second coils form a coil having a length which equals a sum of a length of said first coil and a length of said second coil.

3. The radio communication apparatus of claim 1 wherein, in said retracted position, said conductive plate contacting said conducting ring connects said first and second coils in series.

4. The radio communication apparatus of claim 1, wherein said insulating element is located inside said first coil in said retracted position.

5. An extendable antenna comprising:

an excitation link for connection to a transceiver;

a rod antenna which is electrically connected at a first tip to said excitation link in an extended position and electrically disconnected from said excitation link in a retracted position;

a first coil located around said rod antenna in a housing, said first coil having a first end connected to said excitation link;

a conducting ring located over said housing, said conducting ring contacting a second end of said first coil;

an insulating element located at a second tip of said rod antenna;

a conductive plate located over said insulating element, said conductive plate being perpendicular to said rod antenna and parallel to said conducting ring; and a second coil connected to said conducting plate;

said conducting plate contacting said conducting ring by being located over said conducting ring in said retracted position of said rod antenna.

6. The extendable antenna of claim 5 wherein, in said retracted position, said first and second coils form a coil having a length which equals a sum of a length of said first coil and a length of said second coil.

7. The extendable antenna of claim 5 wherein, in said retracted position, said conductive plate contacting said conducting ring connects said first and second coils in series.

8. The extendable antenna of claim 5, wherein said insulating element is located inside said first coil in said retracted position.

9. An extendable antenna comprising:

a rod antenna which is moveable between an extended position and a retracted position, a first tip of said rod antenna being electrically connected to an excitation ring in said extended position and electrically disconnected from said excitation ring in a retracted position;

a first coil located around said rod antenna in a housing, said first coil having a first end connected to said excitation ring;

a conducting ring located over said housing, said conducting ring contacting a second end of said first coil;

an insulating element located at a second tip of said rod antenna;

a conductive plate located over said insulating element, said conductive plate being perpendicular to said rod antenna and parallel to said conducting ring; and a second coil connected to said conducting plate;

said conducting plate contacting said conducting ring in said retracted position of said rod antenna.

10. The extendable antenna of claim 9 wherein, in said retracted position, said first and second coils form a coil having a length which equals a sum of a length of said first coil and a length of said second coil.

11. The extendable antenna of claim 9 wherein, in said retracted position, said conductive plate contacting said conducting ring connects said first and second coils in series.

12. The extendable antenna of claim 9, wherein said insulating element is located inside said first coil in said retracted position.

* * * * *